US011336012B2

(12) United States Patent
Lee et al.

(10) Patent No.: US 11,336,012 B2
(45) Date of Patent: May 17, 2022

(54) INTERLACED ARRAY ANTENNA

(71) Applicant: Alpha Networks Inc., Hsinchu (TW)

(72) Inventors: Yi Ju Lee, Hsinchu (TW); Rong-Fa Kuo, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 0 days.

(21) Appl. No.: 17/034,199

(22) Filed: Sep. 28, 2020

(65) Prior Publication Data

US 2022/0045426 A1 Feb. 10, 2022

(30) Foreign Application Priority Data

Aug. 5, 2020 (TW) ..... 109126480

(51) Int. Cl.
*H01Q 5/42* (2015.01)
*H01Q 21/28* (2006.01)
*H01Q 5/50* (2015.01)

(52) U.S. Cl.
CPC ..... *H01Q 5/42* (2015.01); *H01Q 5/50* (2015.01); *H01Q 21/28* (2013.01)

(58) Field of Classification Search
CPC H01Q 5/42; H01Q 5/50; H01Q 21/28; H01Q 9/0407; H01Q 9/0428; H01Q 9/045
See application file for complete search history.

(56) References Cited

U.S. PATENT DOCUMENTS 3,806,946 A * 4/1974 Tiuri ..... H01Q 21/12 343/846
3,987,455 A * 10/1976 Olyphant, Jr. ..... H01Q 21/065 333/243
3,995,277 A * 11/1976 Olyphant, Jr. ..... H01Q 21/10 343/846
4,180,817 A * 12/1979 Sanford ..... H01Q 25/004 343/700 MS (Continued)

FOREIGN PATENT DOCUMENTS

TW 200931718 7/2009
WO 2013180436 12/2013

OTHER PUBLICATIONS

Taiwan Intellectual Property Office, "Office action", dated Apr. 14, 2021.

*Primary Examiner* — Dameon E Levi
*Assistant Examiner* — Jennifer F Hu
(74) *Attorney, Agent, or Firm* — WPAT, PC

(57) ABSTRACT

An interlaced array antenna includes first and second groups of antenna units, which are of the same size in the same group and different sizes in different groups. Each antenna unit is polygon-shaped with even-numbered edges, and has feed-in terminal and coupling terminal at two corners. A preceding one and a succeeding one of the antenna units included in the first group are interconnected via a specified one of the antenna units in the second group. An input signal is transmitted through the feed-in terminal and then the coupling terminal of the preceding antenna unit, the feed-in (Continued)

terminal and then the coupling terminal of the specified antenna unit, and the feed-in terminal and then the coupling terminal of the succeeding antenna unit in sequence. Configurations of adjacent two antenna units in the same group are identical once one of them is flipped about the x-axis.

4 Claims, 6 Drawing Sheets

(56) References Cited

U.S. PATENT DOCUMENTS

| | | | | |
|---|---|---|---|---|
| 7,705,782 | B2 * | 4/2010 | Lee | H01Q 21/065 333/116 |
| 7,884,765 | B2 | 2/2011 | Liu et al. | |
| 9,755,311 | B2 * | 9/2017 | Zhou | H01Q 9/0407 |
| 10,938,114 | B2 * | 3/2021 | Kim | H01Q 9/0428 |
| 2004/0080455 | A1 | 4/2004 | Lee | |

* cited by examiner

INTERLACED ARRAY ANTENNA

FIELD OF THE INVENTION

The present invention relates to an array antenna, and more particularly to an interlaced array antenna.

BACKGROUND OF THE INVENTION

An array antenna is configured by allocating a plurality of antenna units in a regular manner, and performs an integrated function of the plurality of antenna units. Please refer to FIG. 1, which schematically illustrates an architecture of currently available series-fed array antenna. In the series-fed array antenna, feed-in terminals of the antenna units are disposed on the same sides of the serially connected antenna units and oriented in the same direction. In addition, the relative positions of the feed-in terminals on respective feed-in sides of the antenna units are similar. For example, as shown in FIG. 1, the series-fed array antenna 10 includes five antenna units 100-140. The feed-in terminals of the five antenna units 100-140 are disposed on the left sides 100*a*-140*a*, and they are all centrally located. On the right sides of the antenna units 100-130 are coupling terminals, which are coupled to feed-in terminals of respective downstream antenna units 110-140 by way of microstrips for signal transmission.

Since the antenna radiation of the above-described series-fed array antenna 10 is basically synthesized in the x-direction and exhibits coherent addition of the antenna units 100-140 in the y-direction, the detecting angle in the y-direction might thus be too narrow to precisely locate an obstacle when the series-fed array antenna 10 is used in a vehicular radar device.

SUMMARY OF THE INVENTION

Therefore, the present invention provides an interlaced array antenna, which has an enlarged emission angle in a direction perpendicular to the extending direction of the array antenna. Meanwhile, a synthesis effect is exhibited in the extending direction of the array antenna. By specifically allocating associated elements, wiring area can be effectively reduced.

An interlaced array antenna according to the present invention includes a first type of antenna group, including a plurality of antenna units of the same first size, wherein each of the antenna units in the first type of antenna group is polygon-shaped with even-numbered edges, and has a feed-in terminal at a corner and a coupling terminal at another corner; and a second type of antenna group, including a plurality of antenna units of the same second size, wherein each of the antenna units in the second type of antenna group is polygon-shaped with even-numbered edges, and has a feed-in terminal at a corner and a coupling terminal at another corner, and the second size is different from the first size. A preceding one and a succeeding one of the antenna units included in the first type of antenna group are interconnected via a specified one of the antenna units in the second type of antenna group, and an input signal is adapted to be transmitted through the feed-in terminal and then the coupling terminal of the preceding antenna unit, the feed-in terminal and then the coupling terminal of the specified antenna unit, and the feed-in terminal and then the coupling terminal of the succeeding antenna unit in sequence. Configurations of the immediately adjacent two antenna units in the same type of antenna group are identical once one of the immediately adjacent two antenna units is flipped about the x-axis.

An interlaced array antenna according to the present invention is capable of working with a wide radiation angle. For example, the angle may be greater than 90 degrees within a short distance. By using different sizes of antenna units and properly allocating the antenna units, a variety of features such as radiation angle, gain, wiring area, etc., can be optimally adjusted.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
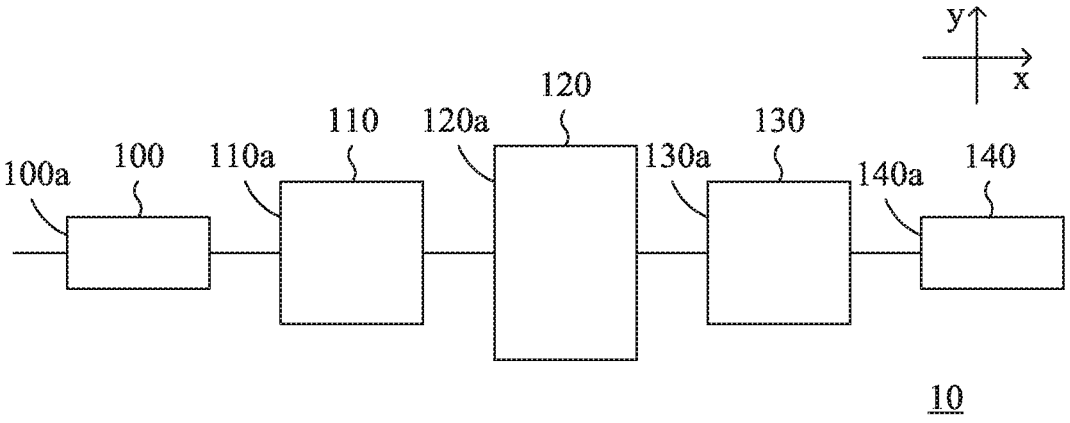
FIG. 1 is a schematic diagram illustrating a configuration of a series-fed array antenna according to prior art.
Figure 2:
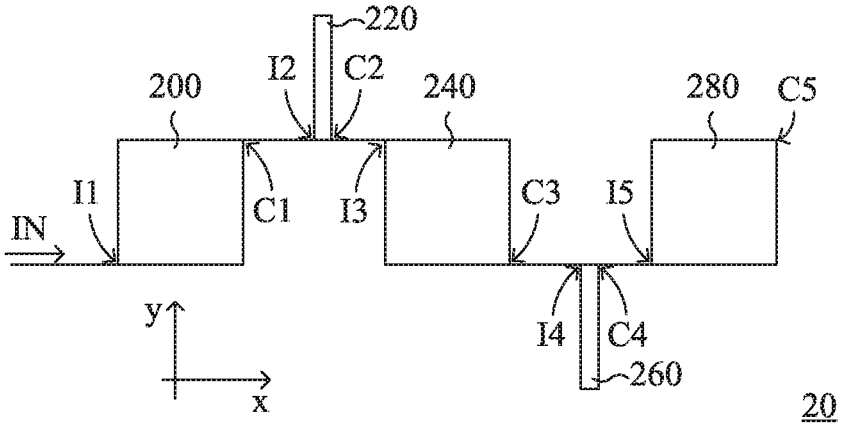
FIG. 2 is a schematic diagram illustrating a configuration of an interlaced array antenna according to the present invention.

Please refer to FIG. 2, which schematically illustrates an interlaced array antenna according to an embodiment of the present invention. In this embodiment, the interlaced array antenna 20 includes a first type of antenna group and a second type of antenna group. The first type of antenna group includes antenna units 200, 240 and 280 of substantially the same first size, the second type of antenna group includes antenna units 220 and 260 of substantially the same second size, and the first size is different from the second size. More specifically, the width of each antenna unit in the first type of antenna group is different from the width of each antenna unit in the second type of antenna group in the x-direction, while the width of each the antenna unit in the first type of antenna group is equal to the width of each the antenna unit in the second type of antenna group in the y-direction. It is to be noted that the dimensions shown in FIG. 2 are for illustration only in order to show different widths of antenna units in the x-direction, and the ratio may vary with practical requirements.

In this invention, each the antenna unit in the first type of antenna group has a feed-in terminal disposed at a corner thereof, and a coupling terminal disposed at another corner thereof. Likewise, each the antenna unit in the second type of antenna group has a feed-in terminal disposed at a corner thereof, and a coupling terminal disposed at another corner thereof. For example, as shown in FIG. 2, the antenna unit 200 has a feed-in terminal I1 disposed at the left lower corner and a coupling terminal C1 disposed at the right upper corner; the antenna unit 240 has a feed-in terminal I3 disposed at the left upper corner and a coupling terminal C3 disposed at the right lower corner; the antenna unit 280 has a feed-in terminal I5 disposed at the left lower corner, and a coupling terminal C5 disposed at the right upper corner; the antenna unit 220 has a feed-in terminal I2 disposed at the left lower corner, and a coupling terminal C2 disposed at the right lower corner; and the antenna unit 260 has a feed-in terminal I4 disposed at the left upper corner, and a coupling terminal C4 disposed at the right upper corner.

Figure 3:
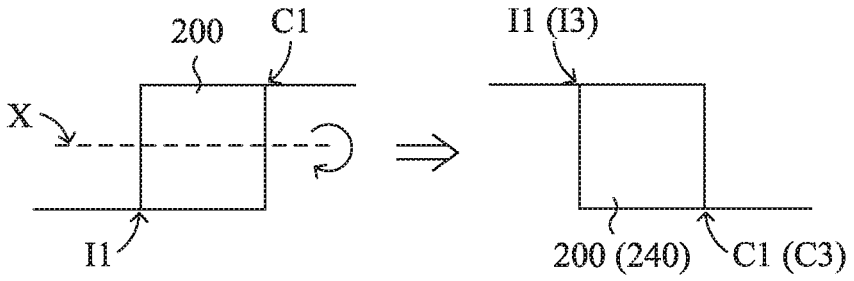
FIG. 3 is a scheme illustrating configurations of two counterpart antenna units included in an interlaced array antenna according to the present invention.

It is to be noted that although the antenna units 200 and 240 are two individual ones, they may be implemented with two identical antenna units, and subjected to some modification. For example, as shown in FIG. 3, by flipping the antenna unit 200 about an axis in the extending direction of the interlaced array antenna, i.e. the x-axis, the configuration would be turned into that of the antenna unit 240. In other words, the two antenna units 200 and 240 may be implemented with substantially identical ones with different orientations.

Likewise, the antenna units 220 and 260 may also be implemented with substantially identical ones with different orientations.

It can be further seen from FIG. 2 that the first type of antenna group and the second type of antenna group are allocated in an interlaced manner. That is, an antenna unit belonging to the second type of antenna group is disposed between two antenna units belonging to the second type of antenna group, and an antenna unit belonging to the first type of antenna group is disposed between two antenna units belonging to the first type of antenna group. For example, the antenna unit 220 is disposed between the antenna unit 200 and the antenna unit 240, and the antenna unit 200 and the antenna unit 240 belonging to the first type of antenna group are interconnected with a transmission line via the antenna unit 220 belonging to the second type of antenna group. The antenna unit 260 is disposed between the antenna unit 240 and the antenna unit 280, and the antenna unit 240 and the antenna unit 280 belonging to the first type of antenna group are interconnected with a transmission line via the antenna unit 260 belonging to the second type of antenna group. Likewise, the antenna unit 240 is disposed between the antenna unit 220 and the antenna unit 260, and the antenna unit 220 and the antenna unit 260 belonging to the second type of antenna group are interconnected with a transmission line via the antenna unit 240 belonging to the first type of antenna group. Accordingly, once an input signal IN enters the interlaced array antenna 20, the input signal IN is transmitted through the feed-in terminal I1, the coupling terminal C1, the second feed-in terminal I2, the coupling terminal C2, the feed-in terminal I3, the coupling terminal C3, the feed-in terminal I4, the coupling terminal C4 and the feed-in terminal I5 in sequence and then reaches the antenna unit 280.

Figure 4A:
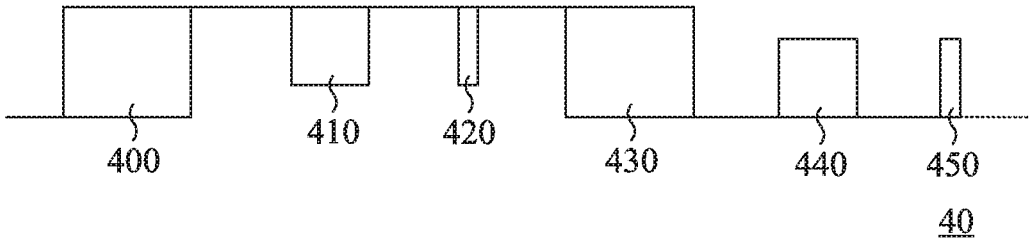
FIG. 4A is a schematic diagram illustrating a configuration of another interlaced array antenna according to the present invention.

Based on the disclosure of the above embodiment of the present invention, those skilled in the art may make some modification to develop analogous embodiments of interlaced array antenna. For example, FIG. 4A schematically illustrates an interlaced array antenna 40, which include three types of antenna groups. The first type of antenna group includes antenna units 400 and 430 of substantially the same size, the second type of antenna group includes antenna units 410 and 440 of substantially the same size, and the third type of antenna group includes antenna units 420 and 450 of substantially the same size. However, the sizes of antenna units belonging to the three types of antenna group are different from one another. Furthermore, the configurations of the immediately adjacent two antenna units in the same type of antenna group, e.g. antenna units 400 and 430, antenna units 410 and 440, and antenna units 420 and 450, are identical once one of the two antenna units is flipped about the x-axis.

Figure 4B:
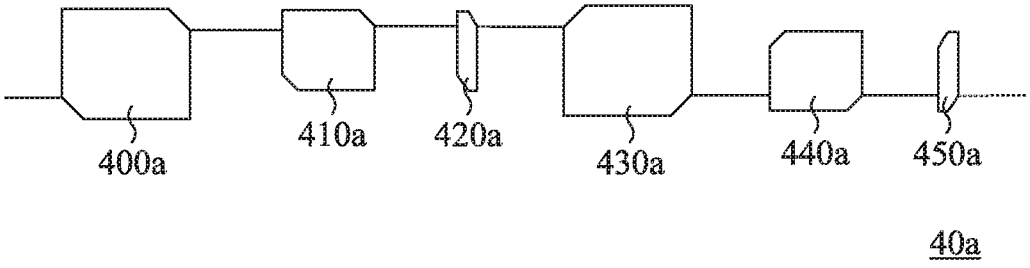
FIG. 4B is a schematic diagram illustrating a configuration of a further interlaced array antenna according to the present invention.
Figure 4C:
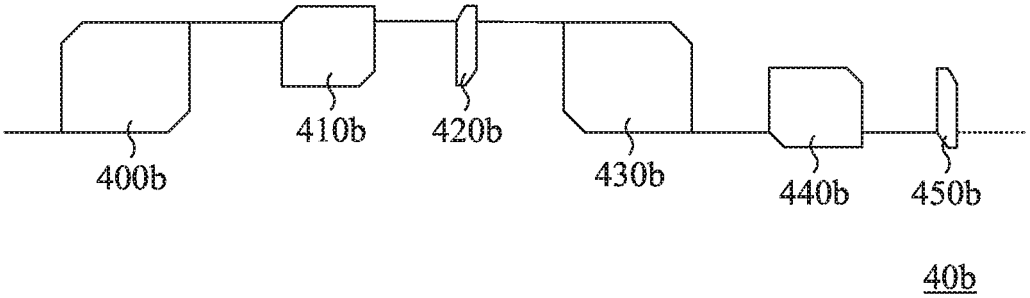
FIG. 4C is a schematic diagram illustrating a configuration of still another interlaced array antenna according to the present invention.

FIG. 4B schematically illustrates an embodiment similar to that shown in FIG. 4A. As shown in FIG. 4B, an interlaced array antenna 40*a* also include first, second and third types of antenna groups, which include antenna units 400*a* and 430*a* of substantially the same size, 410*a* and 440*a* of substantially the same size, and 420*a* and 450*a* of substantially the same size, respectively. The antenna units 400*a*, 430*a*, 410*a*, 440*a*, 420*a* and 450*a* are all hexagonal. The sizes of antenna units belonging to the three types of antenna group are different from one another. It is to be noted that in the embodiment shown in FIG. 4A, the three types of antenna groups are linearly polarized. In contrast, in the embodiment shown in FIG. 4B, the three types of antenna groups are polarized in another way, e.g. elliptically polarized or circularly polarized, as the antenna units are hexagonal. According to the present invention, a physical feature of the interlaced array antenna, such as polarization, can be modified according to practical requirements by changing the configurations or shapes of the antenna units. For example, as shown in FIG. 4C, the antenna units 400*b*-450*b* are further differentiated from the antenna units 400*a*-450*a* shown in FIG. 4B, thereby being polarized in another way.

It is understood from the above descriptions that an interlaced array antenna according to the present invention includes two and more types of antenna groups. The antenna units belonging to the same type of antenna group have substantially the same size. However, the antenna units in different antenna groups have different sizes. Each the antenna unit may be of any polygonal shape as long as it has even-numbered edges more than four. Furthermore, the configurations of the immediately adjacent two antenna units in the same type of antenna group, e.g. antenna units 200 and 240, antenna units 240 and 280, and antenna units 220 and 260 in the embodiment shown in FIG. 2, are identical once one of the two antenna units is flipped about the x-axis.

Figure 5:
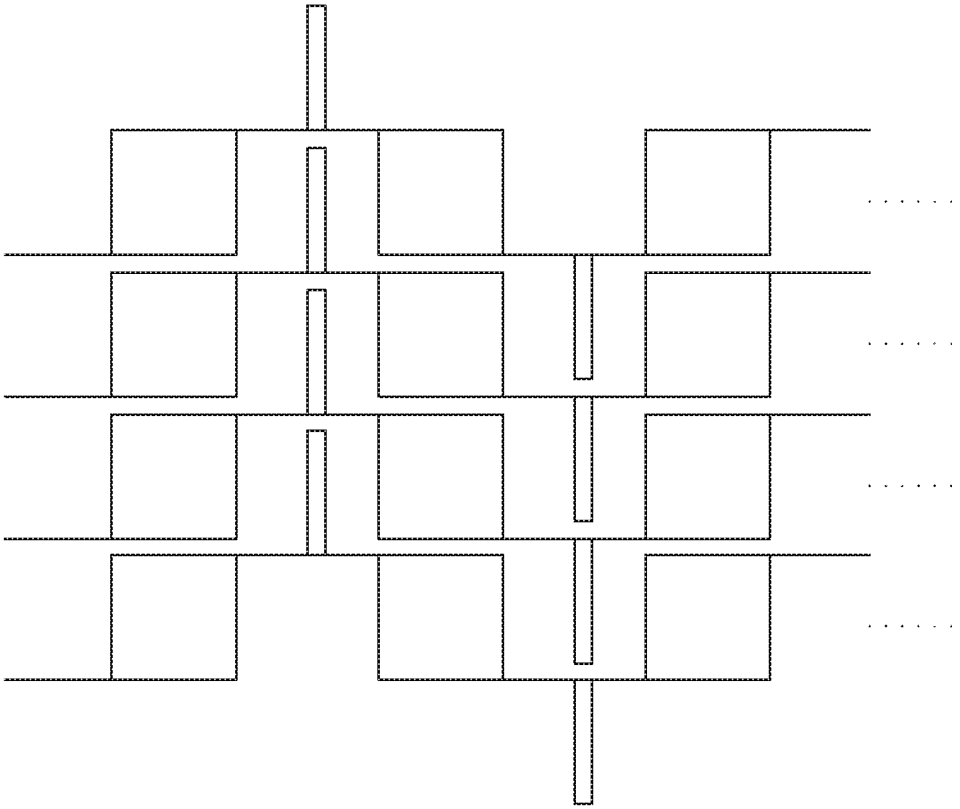
FIG. 5 is a schematic diagram illustrating an assembly of interlaced array antennas, which are allocated in a compact area.

According to the present invention, the relative positions of the feed-in terminal and coupling terminal of an antenna unit in a group are identical to those of any other antenna unit in the same group. However, the relative positions of the feed-in terminal and coupling terminal of an antenna unit in a group may be different from those of an antenna unit in another group. The difference is determined according to practical requirements. For example, in the embodiment shown in FIG. 4A, the feed-in terminal and the coupling terminal of the antenna unit 400 are disposed at diagonal corners. In contrast, the feed-in terminal and the coupling terminal of the antenna unit 410 are disposed at lateral corners. In general, the relative positions of the feed-in terminal and coupling terminal of an antenna unit may be determined depending on a variety of factors. One of the factors is the overall area occupied by the interlaced array antenna. For example, in the embodiment shown in FIG. 5, a plurality of interlaced array antenna can be allocated in a compact area by properly locating the feed-in terminals and coupling terminals of the antenna units. Even though the overall area is reduced, similar intensity of radiation can be maintained.

Figure 6A:
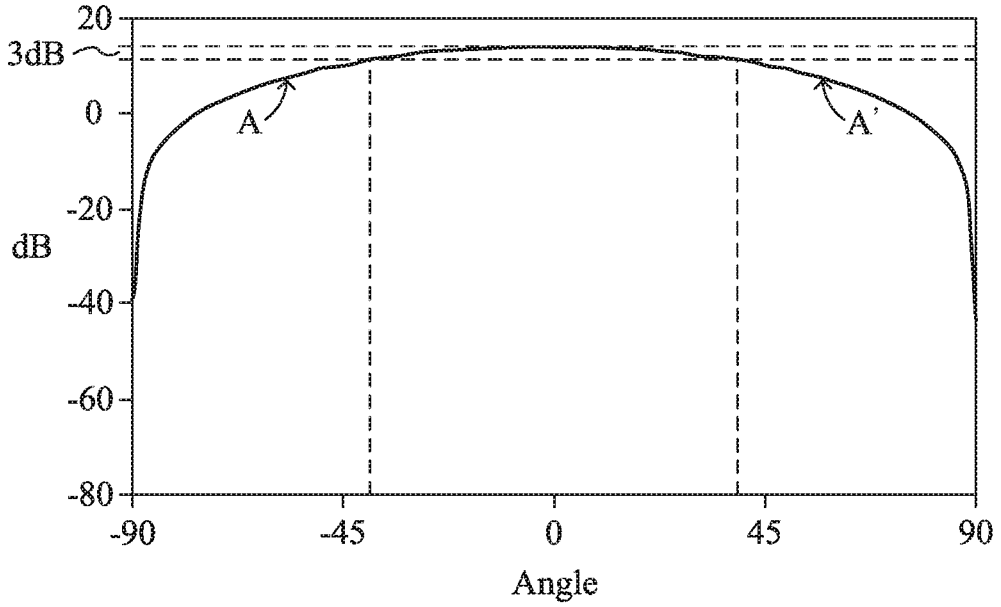
FIG. 6A is an exemplified radiation intensity vs. angle plot of a conventional series-fed array antenna.
Figure 6B:
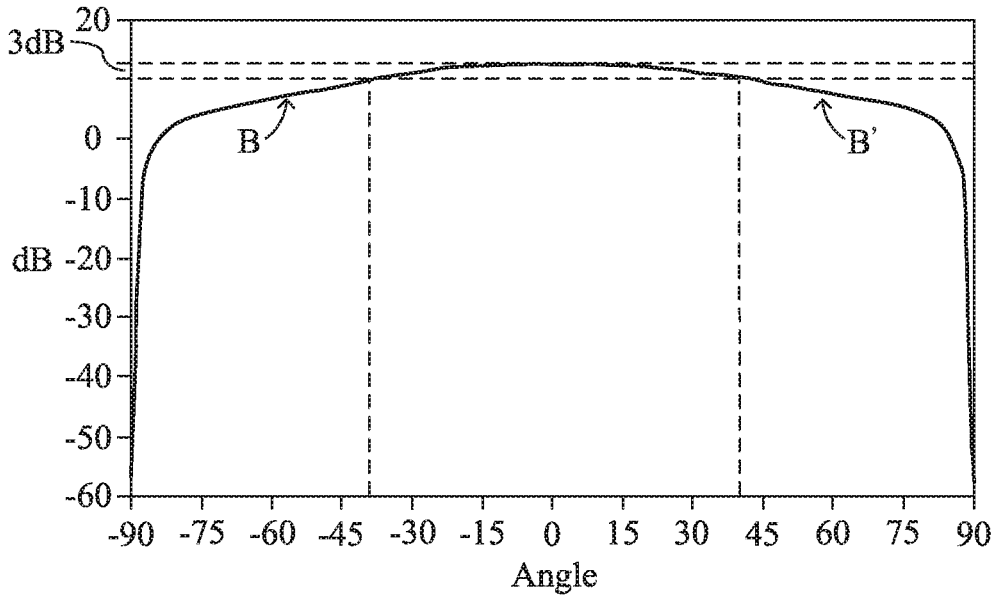
FIG. 6B is an exemplified radiation intensity vs. angle plot of an interlaced array antenna according to an embodiment of the present invention.

The embodiments of interlaced array antennas according to the present invention can provide broader radiation fields than conventional series-fed array antennas. Please refer to FIG. 6A and FIG. 6B, which schematic illustrate radiation intensity vs. angle plots of a conventional series-fed array antenna and a present interlaced array antenna, respectively. It can be seen from the labeled parts A, A' and B, B' respectively shown in FIG. 6A and FIG. 6B that the radiation intensity decays more significantly in the conventional series-fed array antenna shown in FIG. 6A than in the present interlaced array antenna shown in FIG. 6B. In more detail, both cases have similar intensity drops, e.g. 3 dB, within a similar radiation angle range, e.g. between +39 and −39 degrees. However, for a radiation angle beyond this range, the present interlaced array antenna decays less than the conventional series-fed array antennas. Therefore, the present interlaced array antenna is more suitable to be used in an environment requiring broadband and wide angle, e.g. a vehicle radar, than the conventional series-fed array antenna.

Figure 7A:
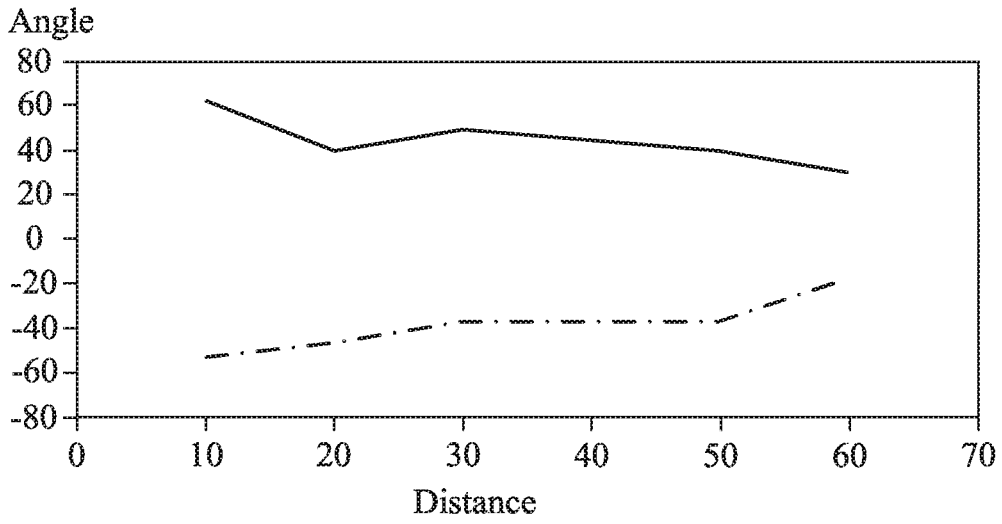
FIG. 7A is an exemplified measurement angle vs. distance plot of a conventional series-fed array antenna.
Figure 7B:
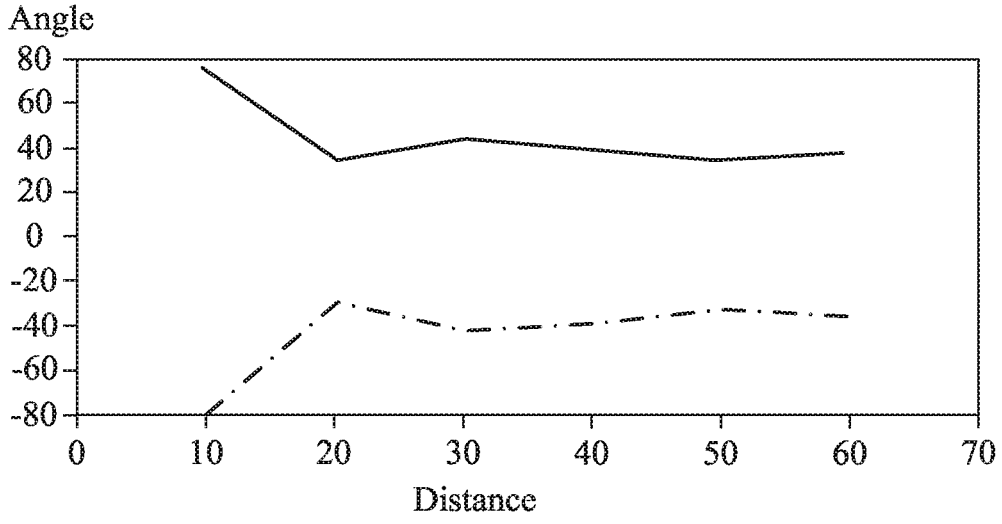
FIG. 7B is an exemplified measurement angle vs. distance plot of an interlaced array antenna according to an embodiment of the present invention.

Furthermore, the embodiments of interlaced array antennas according to the present invention can provide broader measurement ranges than conventional series-fed array antennas. Please refer to FIG. 7A and FIG. 7B, which schematic illustrate measurement angle vs. distance plots of a conventional series-fed array antenna and a present interlaced array antenna, respectively. It can be seen that the conventional series-fed array antenna is capable of providing a sensing distance of about 10 m in a measurement angle ranged between +60 and −60 degrees (FIG. 7A), and the present interlaced array antenna is capable of providing a similar sensing distance in a measurement angle ranged between +80 and −80 degrees (FIG. 7B). Therefore, the present interlaced array antenna apparently provides a wider measurement range. In other words, when applied to a vehicle radar, it can locate obstacles in a wider range.

In view of the forgoing, it is understood that an interlaced array antenna according to the present invention is advantageous in providing a wider radiation-angle range. By way of proper allocation, the wiring area of the array antenna can be minimized. The antenna gain is improved compared to a conventional series-fed array antenna having a similar wiring area.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An interlaced array antenna, comprising:

a first type of antenna group, including a plurality of antenna units, each of the antenna units in the first type of antenna group having a first size, being polygon-shaped with even-numbered edges, and having a feed-in terminal at a corner and a coupling terminal at another corner; and a second type of antenna group, including a plurality of antenna units, each of the antenna units in the second type of antenna group having a second size, being polygon-shaped with even-numbered edges, and having a feed-in terminal at a corner and a coupling terminal at another corner, and the second size is different from the first size;

wherein the antenna units included in the first type of antenna group and the antenna units included in the second type of antenna group are connected in series in an interlacing manner, and a preceding one and a succeeding one of the antenna units included in the first type of antenna group are interconnected via a specified one of the antenna units in the second type of antenna group, and an input signal is adapted to be transmitted through the feed-in terminal and then the coupling terminal of the preceding antenna unit, the feed-in terminal and then the coupling terminal of the specified antenna unit, and the feed-in terminal and then the coupling terminal of the succeeding antenna unit in sequence, and wherein configurations of the immediately adjacent two antenna units in the same type of antenna group are identical once one of the immediately adjacent two antenna units is flipped about the x-axis.

2. The interlaced array antenna according to claim 1, wherein the feed-in terminal and the coupling terminal of each of the antenna units in the first type of antenna group are disposed at two corners that do not share any common edge, and the feed-in terminal and the coupling terminal of each of the antenna units in the second type of antenna group are disposed at two corners that shares a common edge.

3. The interlaced array antenna according to claim 2, wherein each of the antenna units in the first type of antenna group is a patch antenna, and each of the antenna units in the second type of antenna group is a microstrip antenna.

4. The interlaced array antenna according to claim 1, wherein each of the antenna units in the first type of antenna group is a patch antenna, and each of the antenna units in the second type of antenna group is a microstrip antenna.

* * * * *